US007827780B2

(12) United States Patent
Lefebvre et al.

(10) Patent No.: US 7,827,780 B2
(45) Date of Patent: Nov. 9, 2010

(54) ASSEMBLY PROCEDURE FOR THE ADJUSTABLE PIN-VALVE, FUEL SHUT-OFF

(75) Inventors: Guy Lefebvre, St-Bruno (CA); Claude Giardetti, St-Bruno (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1029 days.

(21) Appl. No.: 11/560,067

(22) Filed: Nov. 15, 2006

(65) Prior Publication Data

US 2008/0110178 A1 May 15, 2008

(51) Int. Cl.
*B63H 11/00* (2006.01)
*B64G 1/40* (2006.01)
*B64G 99/00* (2006.01)

(52) U.S. Cl. ..... 60/204; 60/39.091; 60/776; 60/734; 60/761; 60/764; 60/746; 60/243; 251/231; 239/265.17; 239/265.19; 181/213; 181/220

(58) Field of Classification Search ..... 60/776, 60/734, 761, 764, 746, 243, 226.1, 262, 264, 60/770, 783, 772, 796, 39.091, 779, 204; 239/265.17–265.19; 181/213, 220; 251/231–247
See application file for complete search history.

(56) References Cited

U.S. PATENT DOCUMENTS 3,358,455 A * 12/1967 Hunt ..... 60/243
3,376,893 A * 4/1968 McCombs, Jr. ..... 137/599.18
7,163,186 B2 * 1/2007 Opper ..... 251/67
7,581,377 B2 * 9/2009 Daukant ..... 60/39.091

OTHER PUBLICATIONS

U.S. Appl. No. 11/234,180, Guy Lefebvre.

* cited by examiner

*Primary Examiner*—Michael Cuff
*Assistant Examiner*—Craig Kim
(74) *Attorney, Agent, or Firm*—Ogilvy Renault LLP

(57) ABSTRACT

A protocol for assembling a fuel shut off pin valve assembly for a turbo fan engine. The protocol outlines a specific sequence of events in order to ensure failsafe incorporation of a fuel shut off valve assembly within the low pressure turbine area and specifically within the engine casing of the turbo fan.

6 Claims, 8 Drawing Sheets

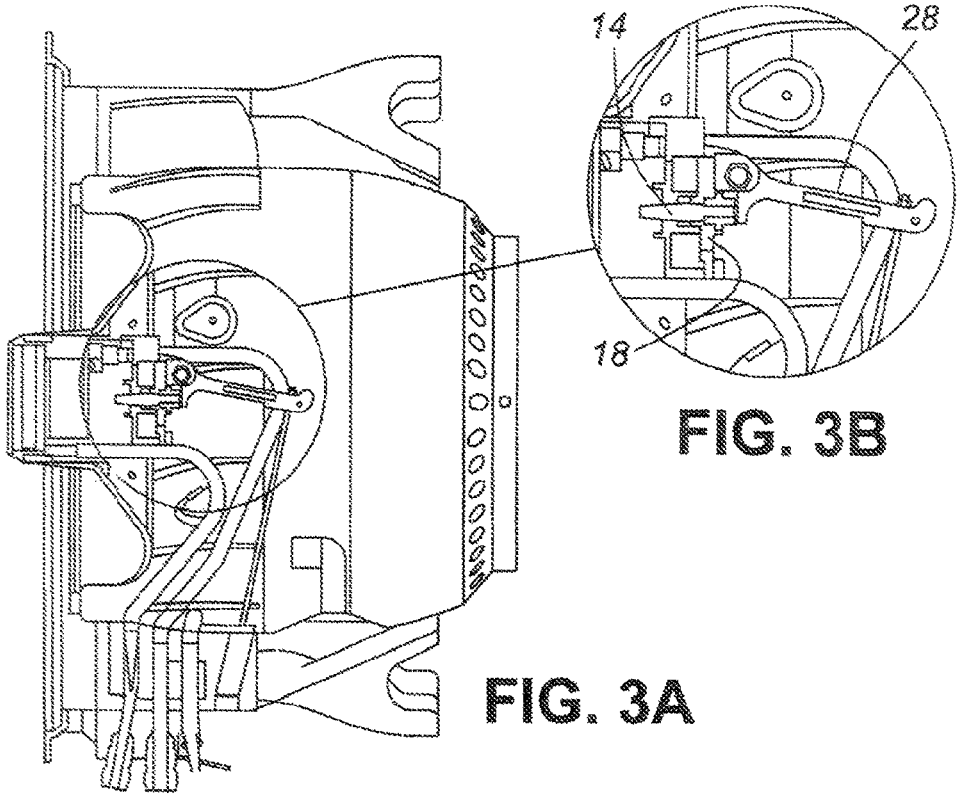
FIG. 3B
FIG. 3A
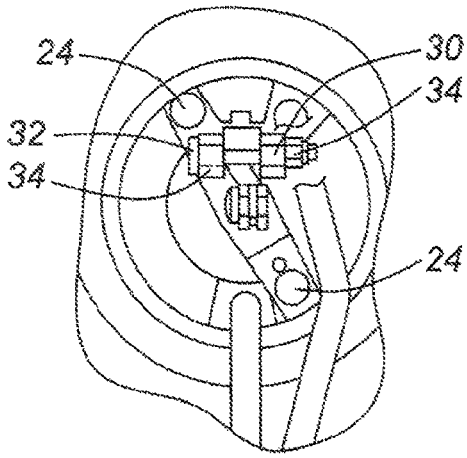
FIG. 3C

ASSEMBLY PROCEDURE FOR THE ADJUSTABLE PIN-VALVE, FUEL SHUT-OFF

TECHNICAL FIELD

The invention relates generally to a fuel shut oil valve and method of assembling the valve.

BACKGROUND OF THE ART

Gas turbine engines typically include a fuel shut-off mechanism to be triggered in the unlikely event of a shaft shear event. The clearance between the trigger of the fuel shut-off mechanism and the triggering component must be very accurately controlled so that the shut-off mechanism performs predictably and as required. Often, the trigger clearance is small—the clearance accuracy required is often within the range of the tolerance stack-up on the engine, and therefore the trigger is typically intentionally oversized, and must undergo a custom grinding operation during assembly to ensure the required triggering clearance, which introduces delay into assembly processes. Any grinding error further delays engine assembly. Customization and rework add unwanted cost and time to assembly. Accordingly, there is a need to provide improvements in gas turbine fuel shut-off mechanisms.

SUMMARY OF THE INVENTION

It is therefore an object of this invention to provide a specific protocol for the assembly of a fuel shut off adjustable pin valve for use in a turbo fan engine.

In one aspect, the present invention provides a method for adjusting the fuel shut off valve in a turbo fan engine, said engine having an exhaust casing surrounding a low pressure turbine, said method comprising: providing a pin valve assembly; providing a support for said pin valve assembly; mounting said pin valve assembly into said support; mounting said assembly and support within said exhaust casing; rotating said pin to determine the extent of resistance to movement; fixedly securing said assembly within said casing; connecting lever means to said support for said pin assembly with a predetermined torque; connecting actuation means to said lever means for selectively actuating said lever means; and determining connected components are secured within said casing.

In another aspect, the present invention provides a method for adjusting the axial gap between low pressure turbine and a pin valve fuel shut off assembly in a turbo fan engine, comprising; measuring said axial gap; rotating said pin valve within a support therefore to adjust said pin to a predetermined position; and securing said pin into said predetermined position.

In a further aspect of the present invention, there is provided a method of mounting a fuel shut-off valve assembly in a gas turbine engine, the engine having an exhaust case support, member, comprising: providing a fuel shut-off assembly having a seal means, pin means, support means, lever means and cable means mounted within an exhaust case; determining a proper height for the pin means when the assembly is mounted to the engine to ensure function of the fuel shut off assembly; determining seating of the pin means within the support means; and mounting the exhaust case to the engine.

Further details of these and other aspects of the present invention will be apparent from the detailed description and figures included below.

DESCRIPTION OF THE DRAWINGS

Reference is now made to the accompanying figures depicting aspects of the present, invention, in which:

FIG. 3A is a side elevational view of the exhaust casing illustrating the fuel supply shut off lever in situ;

FIG. 3B is an enlarged view of the section indicated in FIG. 3A;

FIG. 3C is a view of the assembly in the direction of arrow "A" shown in FIG. 3A;

DETAILED DESCRIPTION OF THE PREFERRED EMBODIMENTS

Figure 1:
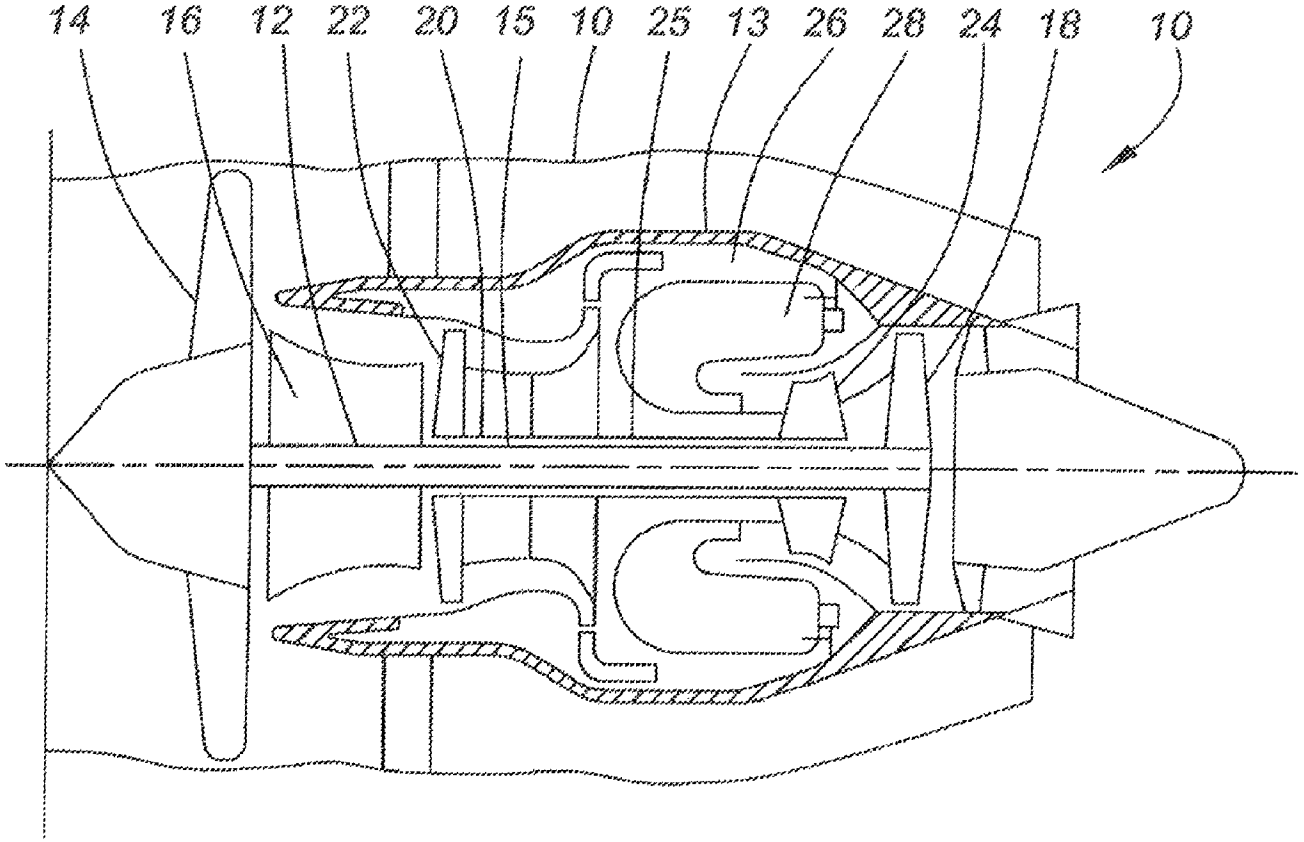
FIG. 1 is a schematic cross-sectional view of a turbofan bypass gas turbine engine, showing an exemplary application of the present invention.

Referring to FIG. 1, a turbofan gas turbine engine incorporating an embodiment of the present invention is presented as an example of the application of the present invention, and includes a housing 10', a core casing 13', a low pressure spool assembly seen generally at 12' which includes a shaft 15' interconnecting a fan assembly 14', a low pressure compressor 16' and a low pressure turbine assembly 18', and a high pressure spool assembly seen generally at 20' which includes a shaft at 25' interconnecting a high pressure compressor assembly 22' and a high pressure turbine assembly 24'. The core casing 13' surrounds the low and high pressure spool assemblies 12' and 20' in order to define a main fluid path (not indicated) therethrough. In the main fluid path there are provided a combustion section 26' having a combustor 28' therein. Pressurized air provided by the high pressure compressor assembly 22' through a diffuser 30' enters the combustion section 26' for combustion taking place in the combustor 28'. Numeral 10 generally denotes the location for the arrangement of the present invention.

Figure 2:
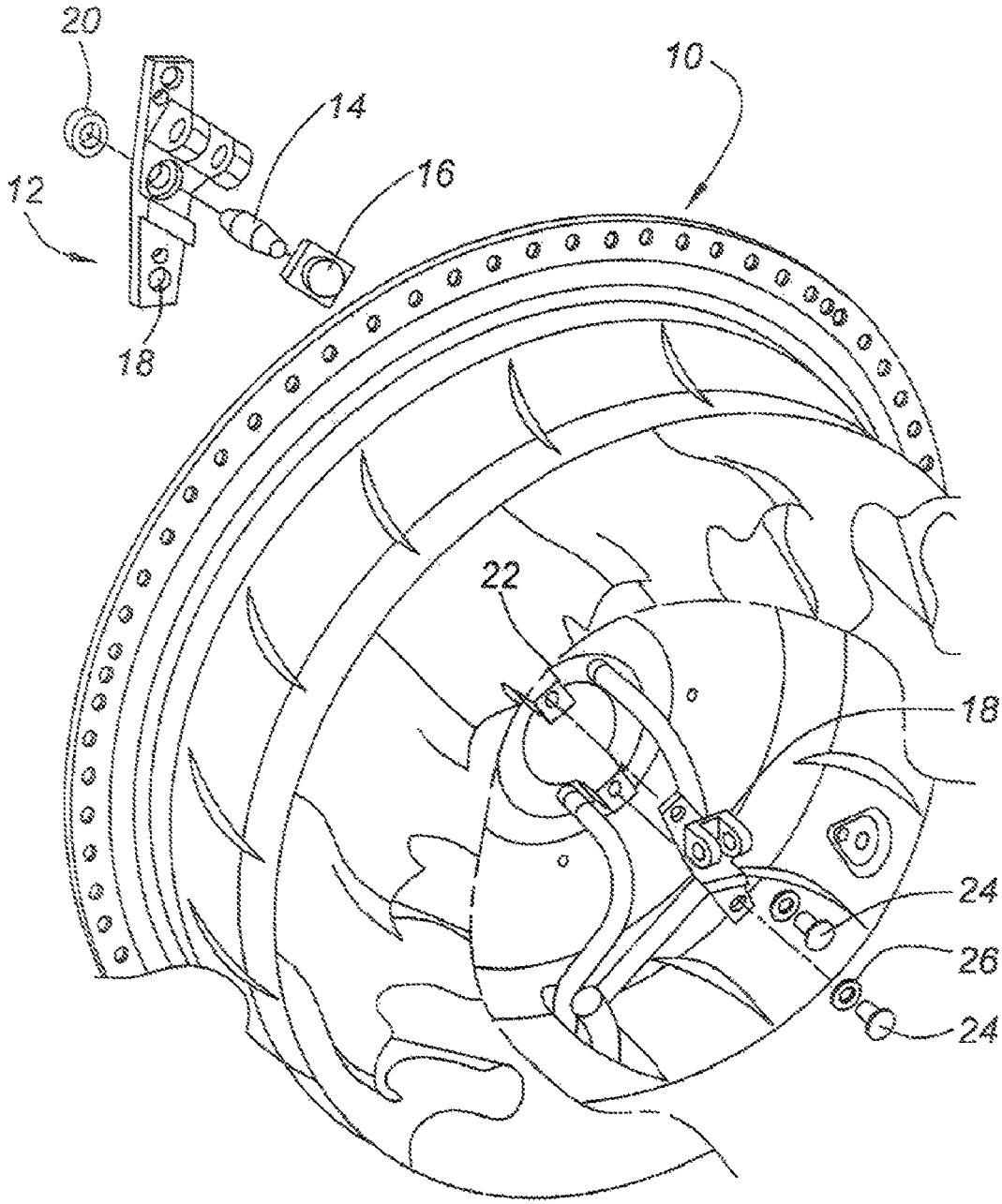
FIG. 2 is a partially cut away exploded view of an engine casing from a turbo fan engine illustrating a fuel supply shut off assembly.

FIG. 2 illustrates the rear of the turbine exhaust case, 10 with the exhaust cone removed therefrom in order to reveal the parts of the system with reference to the assembly pattern. The pin valve assembly is generally denoted by numeral 12 and includes a pin valve 14. The pin valve 14 is screwed into a flange head 16 and then unscrewed approximately for five threads. The sub-assembly of 10, 14 and flange 16 is then subsequently positioned within support 18. A seal 20 is inserted into the pin valve 14 up to the point of the back surface of support 18. The seal 20 is then discarded once positioning has been effected. Once formed, the so formed assembly is inserted in to the turbine exhaust case 10 as is shown in the Figure with parts removed for clarity.

Within the casing 10, there is provided mounts 22, which mounts 22 receive the support 18. Support 18 is fixedly secured to mounts 22 by fasteners 24. Antiseize compound is applied to the threads of fasteners 24. Each fastener then is fixedly secured at a predetermined force, a predetermined torque between 20 pound inches and 26 pound inches in a specific sequence. The sequence involves torquing each fastener alternately in increments of 5 pound inches up to 20-26 pound inches.

During the installation procedure it is important, to ensure that the pin 14 remains movable and to this end, the pin must prevent at least some resistance to movement. This is confirmed by rotating the pin in seal 20 by a quarter of a turn. If no resistance is experienced the pin 14 is removed from support 18 and the seal 20 is replaced. In order to ensure positive engagement, fasteners 24 may also include a locking device, such as locking washers 26.

Referring to FIGS. 3A, B and C, shown are a variety of views of the exhaust case. FIG. 3A illustrates a partially cut away side elevational view. FIG. 3B illustrates an enlarged view of the circular area noted in FIG. 3A. FIG. 3C is a front view looking in the direction of arrow "A" of FIG. 3A. In the above mentioned illustrations, a lever 28 is provided and is mounted to support 18 and more specifically, between lateral supports 30 of support 18.

A nut and bolt 32, 34, respectively extend through registering apertures within support 18 to receive lever 28. Antiseize compound is applied to the threads of the bolt and subsequent torquing of the system is performed between 27 and 30 pound inches. Once fastened, lever 28 is checked for free and clear movement without any binding by applying hand force. This also ensures the full seating of pin 14.

Figures 4A, 4B, 4C, 4D:
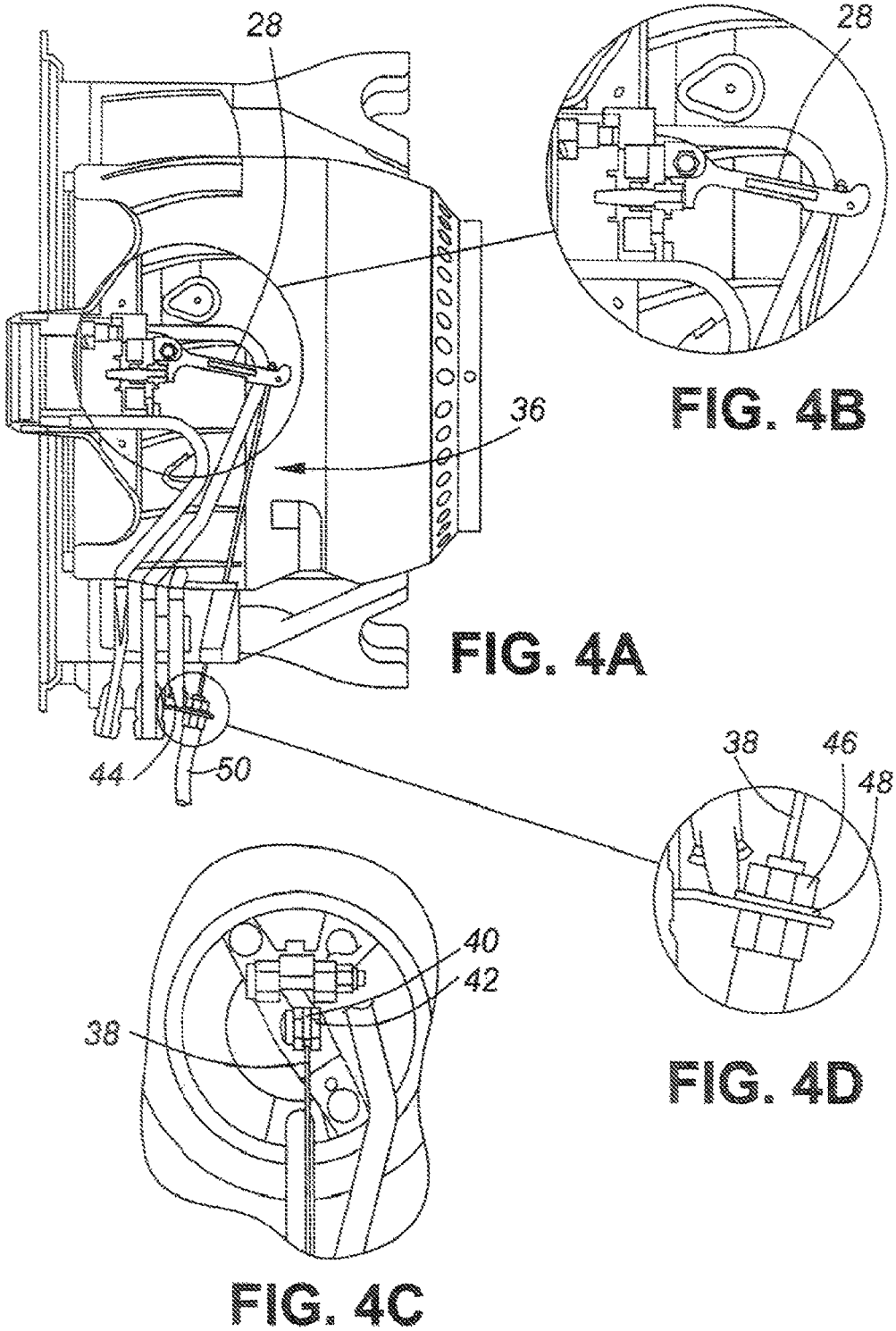
FIG. 4A is a view similar to FIG. 3A with the actuation cable connected to the lever.
FIG. 4B is a view similar to FIG. 3B showing an enlarged area and the position of the cable relative to the lever.
FIG. 4C is a view in the direction A of FIG. 3A.
FIG. 4D is an enlarged view of the area denoted in FIG. 4A.

Referring to the sequence of FIGS. 4A through 4D, shown are various views similar to those in respect to FIGS. 3A, 3B and 3C where the actuation device is provided for lever 28. FIG. 4A illustrates the overall arrangement where lever 28 is connected to a shut off cable assembly, globally denoted by numeral 36. One end of the cable, 38 is fastened adjacent to the terminal end of lever 28. The fastening may be achieved by a ball connector 40 secured in position by a suitable retainer, an example of which is a cotter pin 42. The opposed end of cable 38 terminates at a retaining flange 44 generally associated with the turbine exhaust casing 10. In the mounting procedure, the arrangement includes a washer and nut combination 46, 48. The nut is turned under a predetermined amount of pressure and particularly torqued between 14 and 16 pound inches.

The cable jacket 50 then extends along the body as is typical in turbo fan engines.

Figure 5:
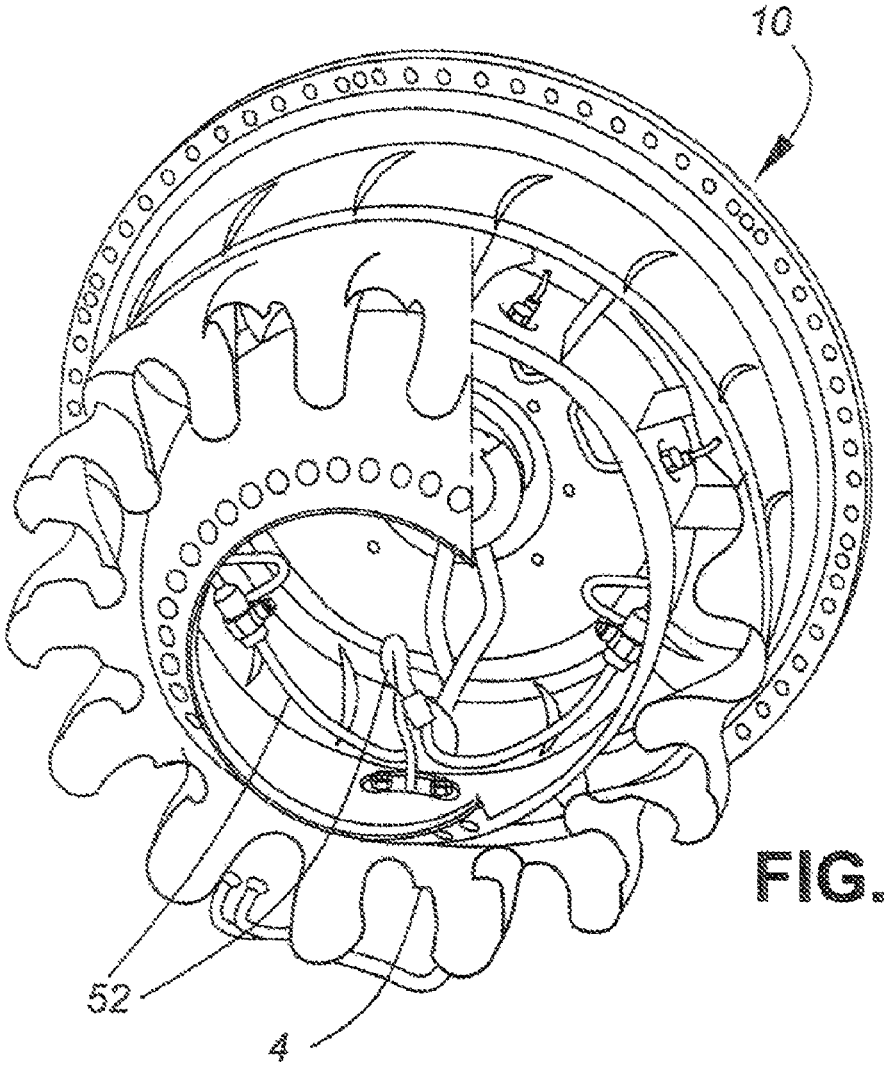
FIG. 5 is a perspective of a partially cut away view of the exhaust casing illustrating some of the components in their respective positions.
Figure 5A:
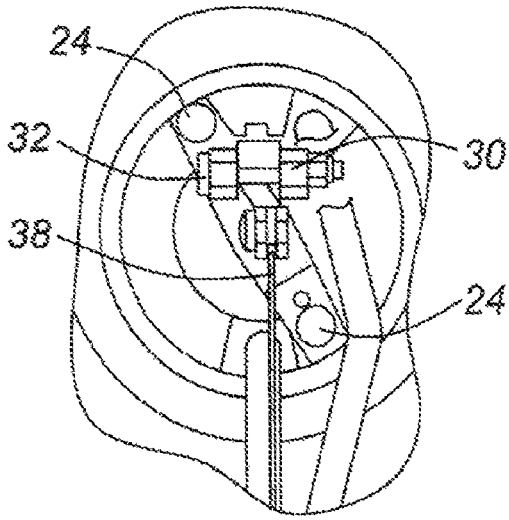
FIG. 5A is a partially cut away view illustrating the positioning of the fuel shut off arrangement in position amongst the wiring and other components associated with the exhaust casing.

Referring to FIGS. 5 and 5A, shown in the first instance is the rear of the turbo fen exhaust casing 10 partially cut away to reveal the disposition of the lever and other components discussed herein previously. The cut away section FIG. 5A clearly illustrates the disposition of the lever within the casing once the arrangement is assembled as has been discussed.

As further steps in the method, once the arrangement is assembled at this stage it is important to ensure that all components are correctly installed and locked. To this end, the cotter pin 42 must be confirmed to be correctly installed and locked into position. It is also at this point that confirmation is made as to whether the nut 32 and bolt 30 of the lever 28 are firmly secured and that the ancillary wiring globally denoted by numeral 52 is securely clamped and secured.

Figure 6:
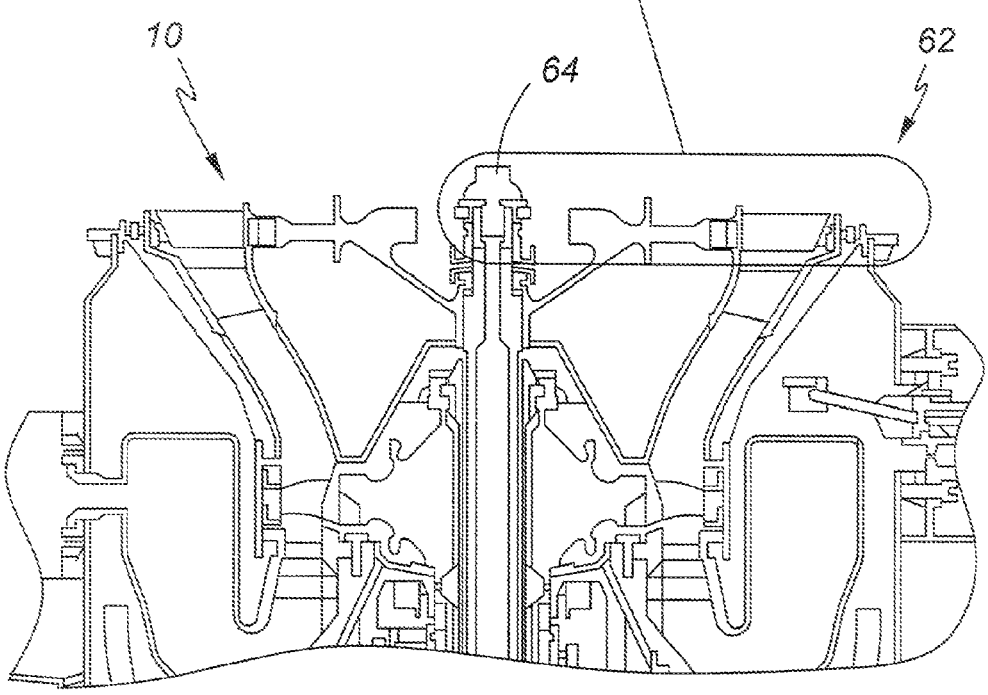
FIG. 6 is a partially cut away cross section of the engine casing of the present invention.
Figure 9:
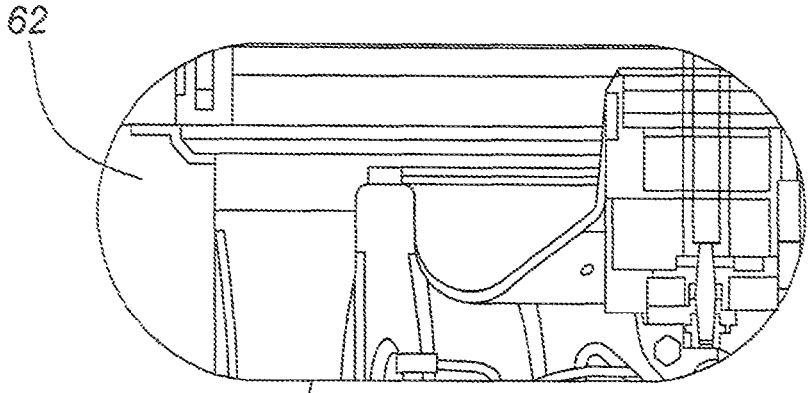
FIG. 9 is an enlarged view of the area circled in FIG. 8.
Figure 8:
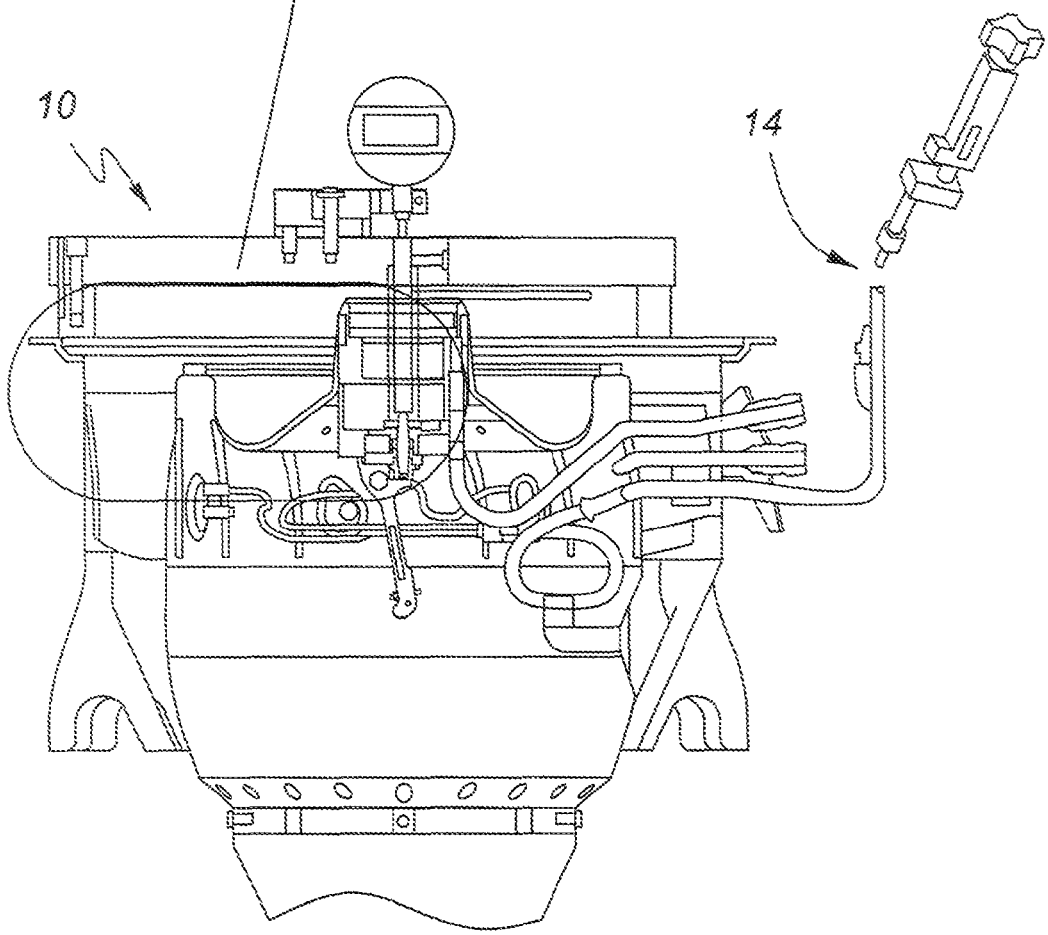
FIG. 8 is a side cross sectional view of the engine casing illustrating further details concerning the fuel shut-off pin assembly.

Finally, once an inspection has been conducted and each of the components is not only functioning properly, but also secured where appropriate and movable where appropriate the sequencing with respect to FIG. 5 and FIG. 6 can be effected.

Figure 7:
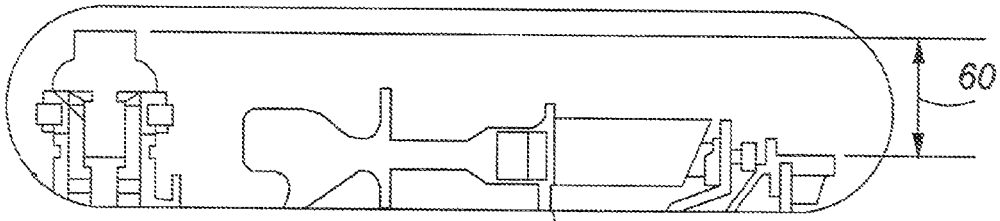
FIG. 7 is an enlarged section of the circled section in FIG. 6.

Referring now to FIGS. 6 and 7, the engine 10 is, in a further embodiment of the method according to the present invention rotated to record the dimension indicated in FIG. 7 by numeral 60. This dimension is a measurement from the turbine support case flange, globally denoted by numeral 62 to the bearing locator bolt 64. This measurement is used to then calculate required pin valve 14 height.

A pulling tool 66 is connected to the pin valve 14 to ensure that the pin is fully seated against its support (numeral designations required for this aspect).

The valve 14 is adjusted by rotation to the proper height in relation to the exhaust case flange 62.

Figure 10:
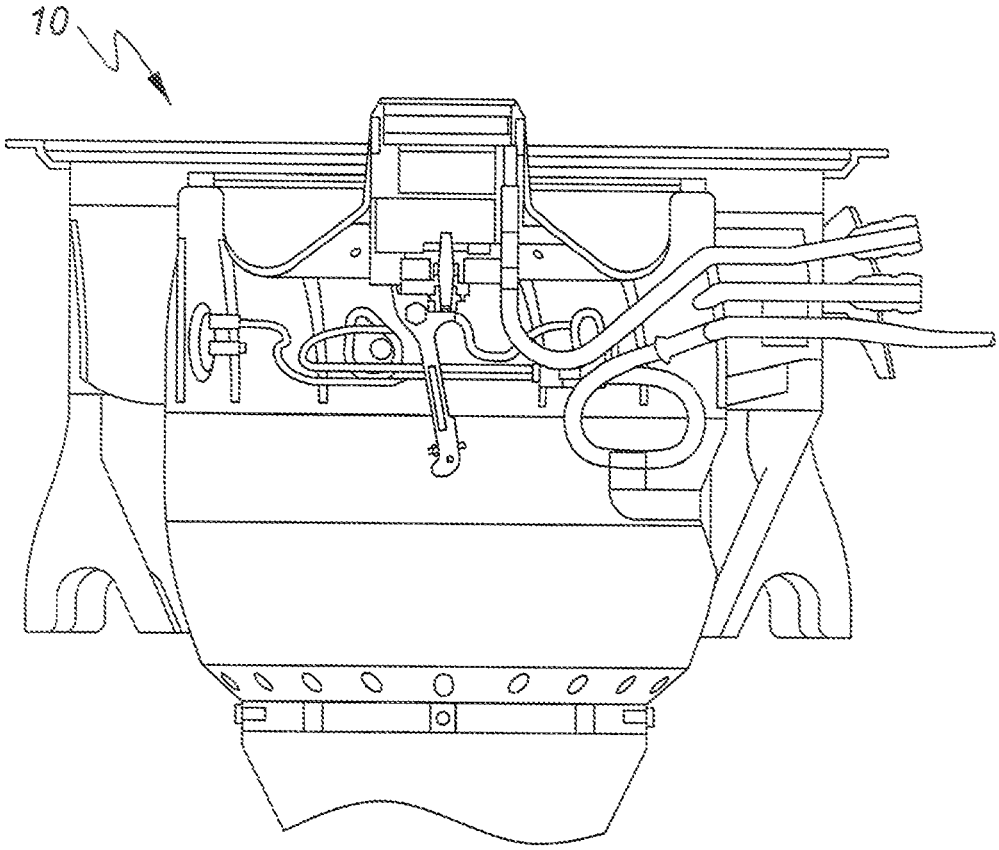
FIG. 10 is a further view of the engine casing.
Figure 11:
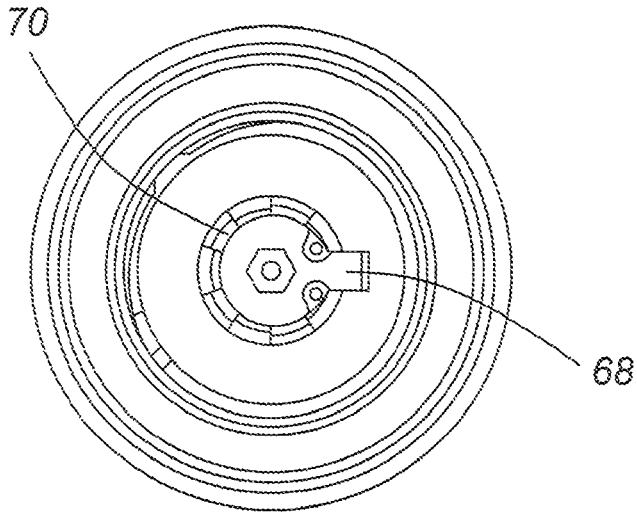
FIG. 11 is a view taken from the direction of the arrow in FIG. 10.

As shown in FIGS. 10 and 11, once the pin has been adjusted, it is important to ensure that the pin remains in this position. Accordingly, as shown in FIG. 11, a washer lock 68 is positioned on to the support flange 62 and secured there with retaining ring 70 as illustrated in FIG. 11.

The case is then installed on engine in a known manner.

The above description is meant to be exemplary only, and one skilled in the art will recognize that changes may be made to the embodiments described without department from the scope of the invention disclosed. Still other modifications which fail within the scope of the present invention will be apparent to those skilled in the art, in light of a review of this disclosure, and such modifications are intended to fall within the appended claims.

The invention claimed is:

1. A method for adjusting the fuel shut off valve in a turbo fan engine, said engine having an exhaust casing surrounding a low pressure turbine, said method comprising:

providing a pin valve assembly;

providing a support for said pin valve assembly;

mounting said pin valve assembly into said support;

mounting said assembly and support within said exhaust casing;

rotating a pin of said valve assembly to determine the extent of resistance to movement;

fixedly securing said assembly within said casing;

connecting lever means to said support for said pin assembly with a predetermined torque;

connecting actuation means to said lever means for selectively actuating said lever means; and determining connected components are secured within said casing.

2. The method as defined in claim 1, further including the step of repositioning said pin valve relative to said support.

3. The method as defined in claim 1, wherein said lever means is connected to said support at a torque of between 27 and 30 pound inches.

4. The method as defined in claim 1, further including the step of applying antiseize compound to fixedly secured members.

5. The method as defined in claim 1, further including mounting an exhaust cone to said exhaust casing.

6. The method as defined in claim 5, wherein said exhaust cone is mounted to said exhaust casing at a torque of between 27 and 30 pound inches.

* * * * *